United States Patent [19]

Bosshard

[11] Patent Number: 4,558,628

[45] Date of Patent: Dec. 17, 1985

[54] BREECHBLOCK BUFFER FOR AN AUTOMATIC FIRING WEAPON

[75] Inventor: Werner Bosshard, Zurich, Switzerland

[73] Assignee: Werkzeugmaschinenfabrik Oerlikon-Bührle AG, Zurich, Switzerland

[21] Appl. No.: 619,564

[22] Filed: Jun. 8, 1984

[30] Foreign Application Priority Data

Jul. 5, 1983 [CH] Switzerland ..... 3681/83

[51] Int. Cl.[4] ..... F41D 11/12

[52] U.S. Cl. ..... 89/198; 188/268; 188/271; 188/314

[58] Field of Search ..... 89/198; 188/268, 271, 188/314

[56] References Cited

U.S. PATENT DOCUMENTS 2,496,323 2/1950 Waltke ..... 89/198

FOREIGN PATENT DOCUMENTS

| | | |
|---|---|---|
| 695584 | 8/1940 | Fed. Rep. of Germany . |
| 710302 | 9/1941 | Fed. Rep. of Germany . |
| 737264 | 9/1943 | Fed. Rep. of Germany . |
| 2921542 | 12/1980 | Fed. Rep. of Germany . |
| 352257 | 3/1961 | Switzerland . |
| 577010 | 5/1946 | United Kingdom . |

*Primary Examiner*—Stephen C. Bentley
*Attorney, Agent, or Firm*—Werner W. Kleeman

[57] ABSTRACT

A breechblock buffer serves for catching the recoiling breechblock following the firing of a cartridge. This breechblock buffer comprises a buffer piston and a compressible liquid. With the heretofore known breechblock buffers there is provided a container housing a compressed gas. The invention contemplates eliminating the need for such container. Instead of a gas container there is provided a packet or set of plate springs serving as an elastic structure. Furthermore, the breechblock buffer possesses a recoil buffer device. For guiding and sealing the buffer piston, a guide ring is arranged between two sealing rings.

5 Claims, 2 Drawing Figures

BREECHBLOCK BUFFER FOR AN AUTOMATIC FIRING WEAPON

BACKGROUND OF THE INVENTION

The present invention broadly relates to weapon systems, and, more specifically, relates to a new and improved construction of a breechblock buffer or cushioning device for an automatic firing weapon.

Generally speaking, the breechblock buffer of the present development is of the type comprising a buffer housing containing therein two chambers. A buffer piston is arranged in a first one of these chambers and an elastic element in the second one of these chambers. A check or non-return valve, which flow communicates both chambers with one another, opens only towards the first chamber.

With a known breechblock buffer of this type, as disclosed for instance in Swiss Pat. Nos. 352,257 and 582,342, there is employed as the elastic element a gas-filled container. This gas-filled container can be either fabricated of rubber or from a metallic bellows. This state-of-the-art breechblock buffer is, however, afflicted with the following drawbacks:

1. The gas-filled container is associated with the disadvantage that for the refilling of the gas-filled container there is required the availability of an appropriate gas flask or bottle and that it is not readily discernible whether the container still possesses adequate gas pressure.

2. The recoil energy of the buffer piston cannot be adequately dampened with this known breechblock buffer, so that there prevails relatively great wear of the entire breechblock buffer.

3. The leakage losses of the hydraulic fluid are relatively large for the heretofore known breechblock buffer constructions. This is afflicted with the shortcoming that it is repeatedly necessary to be aware of whether or not there is available sufficient hydraulic liquid.

SUMMARY OF THE INVENTION

Therefore, with the foregoing in mind, it is a primary object of the present invention to provide a new and improved construction of breechblock buffer or cushioning device for an automatic firing weapon which is not afflicted with the forementioned shortcomings and drawbacks of the prior art.

Another and more specific object of the present invention aims at the provision of a new and improved construction of breechblock buffer which specifically does not have associated with it the three aforementioned drawbacks.

Yet a further specific object of the present invention aims at a new and improved construction of breechblock buffer for an automatic firing weapon which enables reliably indicating the still available liquid pressure and the still available quantity of liquid.

A further important object of the present invention is concerned with an improved breechblock buffer for an automatic firing weapon, wherein the dampening and sealing of the components movably arranged in the breechblock buffer, particularly the buffer piston, are improved.

Now in order to implement these and still further objects of the invention, which will become more readily apparent as the description proceeds, the breechblock buffer of the present development is manifested by the features that the elastic element comprises a piston which is displaceable in the second chamber and which can be loaded by a packet or set of plate springs, that a recoil buffer structure or buffer device is located in the first chamber and consists of a number of spring or resilient ring members, and that the buffer piston is provided with a guide ring arranged between two sealing rings.

The breechblock buffer or cushioning device of the present development, in contrast to the heretofore discussed prior art construction of breechblock buffers, possesses the following advantages:

1. Owing to the use of a packet or set of plate springs as the elastic means or element, instead of a gas container, the breechblock buffer is extensively insensitive to temperature fluctuations.

2. By virtue of the recoil buffer structure or device the wear of individual parts of the breechblock buffer is appreciably less.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
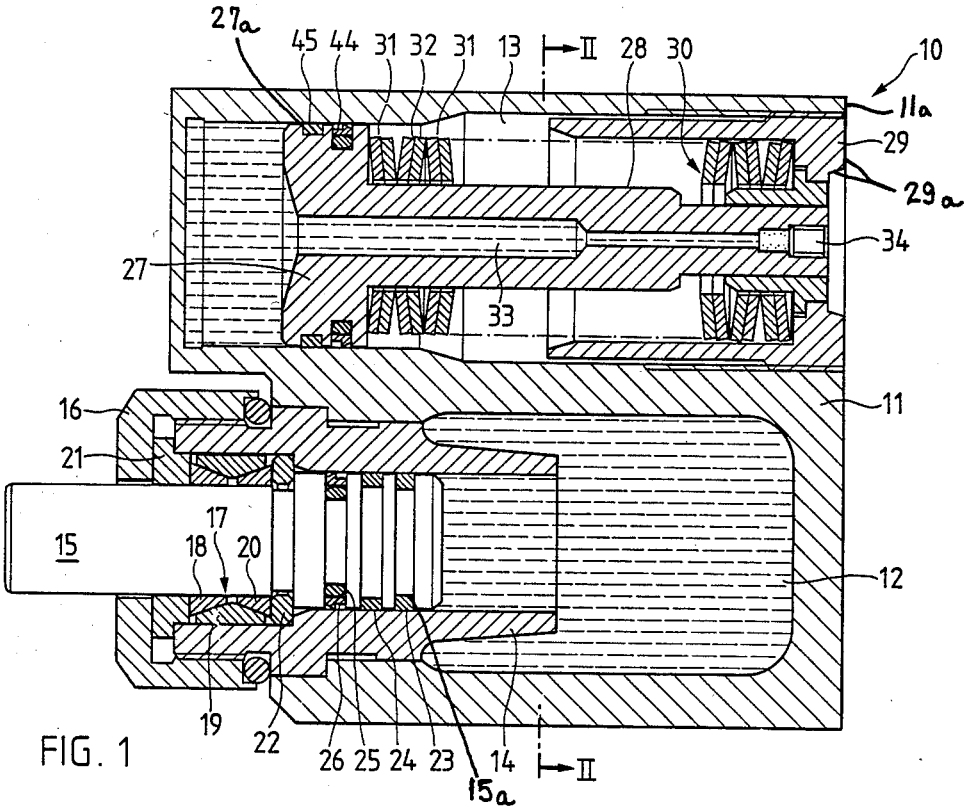
FIG. 1 is a longitudinal sectional view through a breechblock buffer constructed according to the present invention.

Describing now the drawings, it is to be understood that only enough of the construction of the details of the breechblock buffer has been illustrated in the drawings to simplify the showing thereof while still enabling those skilled in the art to readily understand the underlying principles and concepts of the present development. According to the showing of FIG. 1, the therein depicted exemplary embodiment of breechblock buffer 10 will be seen to comprise a buffer housing 11 within which there are located two substantially cylindrical chambers 12 and 13. The lengthwise axes of these two chambers 12 and 13 are aligned essentially in parallelism to one another. Inserted into the first chamber 12 is a sleeve member or sleeve 14 within which there is displaceably guided a buffer piston or piston member 15. The sleeve member 14 is closed by a cover 16 having an opening through which piercingly extends the left-end of the buffer piston 15 shown in FIG. 1. In the sleeve member 14 there is located, apart from the buffer piston 15, also a recoil buffer structure or device 17 which is here shown composed of three spring or resilient rings or ring members 18, 19 and 20. As to these spring or resilient rings 18, 19 and 20 it will be seen that both of the spring rings 18 and 20 bear by means of their external conical surfaces at an inner conical surface of the spring or resilient ring 19. The spring ring 18 bears at an end surface thereof, by means of a ring member 21, at the cover 16, and the spring or resilient ring 20 bears by means of an end surface, via a ring 22, at a shoulder of the buffer piston 15. For sealing and guiding purposes the buffer piston 15 is provided within three substantially ring-shaped or angular grooves 15*a* with a metallic sealing ring 23, a guide ring 24 formed of plastic, and two sealing rings 25 and 26 likewise formed of plastic, as shown in FIG. 1.

In the second chamber 13 there is displaceably guided a pressure piston or piston member 27 with which there is attached a piston rod 28. This piston rod 28 piercingly extends through a substantially pot-shaped cover or cover member 29. The piston rod 28 is surrounded by a packet or set of plate springs 30 defining a measuring spring structure as will be explained hereinafter. This packet of plate springs 30 consists of a number of resilient or spring plates 31, 32 possessing a substantially conical-shaped inner side and a substantially conical-shaped outer side. Each two respective spring plates 31 are directed with their inner side towards the piston 27 and each two respective neighboring spring plates 32 are directed with their outer side towards the piston 27. The plate spring packet or set 30 bears at its one end at the pressure piston 27 and at its other end upon the cover or cover member 29 which is threadably secured into the buffer housing 11. The piston 27 and the piston rod 28 possess a central bore 33 which is closed at one end by a plug 34 or equivalent closure structure.

Figure 2:
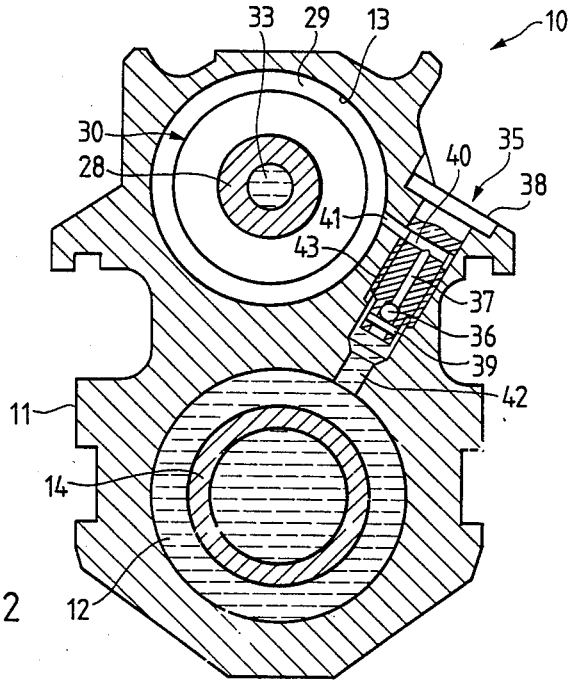
FIG. 2 is a cross-section through the breechblock buffer of FIG. 1, taken substantially along the line II—II thereof.

According to the showing of FIG. 2, both of the chambers 12 and 13 are connected with one another in flow communication by means of a check or non-return valve 35 or equivalent flow control structure. This check or non-return valve 35 permits the throughflow of hydraulic fluid or fluid medium only from the second chamber 13 into the first chamber 12, or stated in another way, the check or non-return valve 35 only opens in the direction of the first chamber 12. This check valve 35 possesses a ball or spherical member 36 which can close an axial bore 37 in a plug member 38. A pin 39 which is secured in the plug member 38 prevents the ball member 36 from dropping out of the check valve 35. The plug 38 furthermore possesses a transverse bore 40 which piercingly extends through the aforementioned axial bore 37, so that fluid can flow from one bore into the other bore. The transverse bore 40 is connected by means of a channel 41 with the second chamber 13 and the axial bore 37 is connected by means of a channel 42 with the first chamber 12. The plug or plug member 38 possesses a threaded portion 43 and is threaded into the buffer housing 11. This threaded portion 43 renders possible the through passage of relatively low amounts of fluid from the channel 42 into the channel 41, even when the ball member 36 completely seals the bore 37, provided that the pressure in the chamber 12 is appreciably higher than in the chamber 13. The piston 27 possesses two ring-shaped or angular grooves **27*a* in which there are seated a guide ring 45 and a sealing ring 44**, respectively.

The mode of operation of the heretofore described breechblock buffer or cushioning device is as follows:

The described breechblock buffer or cushioning device 10 is located at the rear end of the travel path of a conventional breechblock of a firing weapon which therefore has not been particularly shown in the drawings to simplify the illustration. The breechblock moves, following the firing of a shot, towards the rear and impacts against the buffer piston 15 of the breechblock buffer 10. Due to this recoiling impact motion of the breechblock against the buffer piston 15 the latter is displaced and compresses the liquid or fluid medium, for instance silicone oil which is contained in the first chamber 12. During this compression of the liquid contained in the first chamber 12 the check or non-return valve 35 prevents liquid from moving out of the first chamber 12 into the second chamber 13. As soon as the breechblock has again moved forward or in counter-recoil motion and no longer presses against the buffer piston 15, then the liquid located in the first chamber 12 can again expand, and the buffer piston 15 likewise can move forwardly and impact against the recoil buffer structure or device 17. Due to the friction between the three spring rings 18, 19 and 20 the movement of the buffer piston 15 is dampened.

In the second chamber 13 there is located forwardly of the piston or piston member 27 likewise a quantity of liquid which is pressurized due to the action of the pre-biased or pre-stressed plate spring packet or set 30. The pre-biasing of the plate spring packet 30 can be regulated with the aid of the threaded-in, substantially pot-shaped cover member or cover 29. This pre-biasing action has attained the desired value when the end of the piston rod 28 is flush with the floor or base **29*a* of the cover 29, as has been depicted in FIG. 1. From the position of the cover or cover member 29 in the buffer housing 11 there can be discerned whether sufficient liquid is located in both of the chambers 12 and 13. When both of the chambers 12 and 13 contain sufficient liquid, then the floor 29*a* of the cover member 29 is flush with the rear end face or surface 11*a* of the buffer housing 11, as likewise shown in FIG. 1. Consequently, the described construction of breechblock buffer 10 possesses two indicator devices which clearly indicate the magnitude of the pressure prevailing in the chambers 12 and 13 and how much liquid is located in both of these chambers 12 and 13**.

Upon impact of the breechblock against the buffer piston 15 pressure surges or peaks, amounting up to, for instance, 1000 bar, prevail within the chamber 12. The sealing rings 23, 25 and 26 serve to prevent that in the presence of such pressure there will arise impermissibly large leakage losses. Within the chamber 13 there prevails a constant pressure of, for instance, 100 bar. The sealing ring 44 prevents that liquid will flow out of the chamber 13. Since at this location there do not arise any high pressure peaks or surges, the sealing problem at this location is of lesser magnitude.

While there are shown and described present preferred embodiments of the invention, it is to be distinctly understood that the invention is not limited thereto, but may be otherwise variously embodied and practiced within the scope of the following claims.

Accordingly, I claim:

1. A breechblock buffer for an automatic firing weapon, comprising:

a buffer housing provided with two chambers therein;

said two chambers defining a first chamber and a second chamber;

a buffer piston arranged in said first chamber;

an elastic element arranged in said second chamber;

a check valve for flow communicating both of said first and second chambers with one another;

said check valve only opening in the direction of said first chamber;

said elastic element comprising a piston member displaceably arranged in the second chamber and loaded by a plate spring packet;

recoil buffer means located in the first chamber and cooperating with said buffer piston;

said recoil buffer means comprising a number of spring ring members;

two sealing rings and a guide ring provided for said buffer piston; and said guide ring being arranged between said two sealing rings.

2. The breechblock buffer as defined in claim 1, further including:

means for indicating the pressure of a liquid medium contained in both chambers of the breechblock buffer.

3. The breechblock buffer as defined in claim 1, further including:

means for indicating the quantity of a liquid medium within both of the chambers of the breechblock buffer.

4. The breechblock buffer as defined in claim 2, wherein:

said plate spring packet serves, apart for generating a liquid medium pressure in both of the chambers, also for measuring such pressure and is structured for this purpose as a measuring spring structure.

5. The breechblock buffer as defined in claim 3, further including:

a cover member threadable into the breechblock housing and serving for pre-biasing the plate spring packet; and said cover member serving for the indication of the degree of filling of the two chambers with the liquid medium.

* * * * *